United States Patent [19]

Nusbaumer et al.

[11] Patent Number: 4,577,898

[45] Date of Patent: Mar. 25, 1986

[54] GRIPPER APPARATUS

[75] Inventors: Kay T. Nusbaumer, Fort Wayne; Bruce D. McIntosh, Monroeville, both of Ind.

[73] Assignee: PHD, Inc., Fort Wayne, Ind.

[21] Appl. No.: 619,819

[22] Filed: Jun. 12, 1984

[51] Int. Cl.[4] ..... B25B 1/00

[52] U.S. Cl. ..... 294/88

[58] Field of Search ..... 294/88, 104, 106, 115, 294/103.1, 118, 90, 86.4, 33, 95, 97; 414/226, 732, 739, 740, 753; 269/32, 34, 201, 228, 239; 901/31

[56] References Cited

U.S. PATENT DOCUMENTS 3,386,297 6/1968 Willis ..... 294/88

4,243,257 1/1981 Shackleford ..... 294/88

*Primary Examiner*—James B. Marbert

*Attorney, Agent, or Firm*—George A. Gust

[57] ABSTRACT

A gripping apparatus is provided which includes a pair of jaw pads that are independently and pivotally mounted to a pair of bell cranks which are spaced apart from each other and which are pivotally mounted to a supporting structure; the supporting strucuture is mounted to a power cylinder; the power cylinder provides oscillating actuation of the bell cranks through a dog retainer and a spherical portion of the bell cranks; and parallel mechanisms, which include one lever arm of each of the bell cranks, and which include a pair of parallel links, keep pad surfaces of the jaw pads parallel to each other as the lever arms of the bell cranks move arcuately.

16 Claims, 6 Drawing Figures

GRIPPER APPARATUS

The present invention relates generally to pneumatically and hydraulically operated gripping apparatus having opposed jaw pads, and more particularly to a gripping apparatus having parallel linkage which results in a parallel movement of the jaw pads.

BACKGROUND ART

Various types of pneumatically or hydraulically operated grippers are available. These generally include a power cylinder having a piston rod projecting from one end of a cylinder body with two opposed jaws being movably mounted on the cylinder body and being actuated toward and away from each other by movement of the piston.

In patent application Ser. No. 517,329, filed July 26, 1983, entitled, "Hydraulic Gripper Apparatus", inventors Kay T. Nusbaumer and Bruce D. McIntosh, of common assignee, a gripping apparatus is disclosed which includes two bell cranks each having a pivot axis, each having a first lever arm that extends from the pivot axis thereof and that includes a remote end.

A jaw pad is pivotally attached to the respective ones of the first lever arms proximal to the remote ends thereof.

Each of the bell cranks also has a second lever arm that extends from the pivot axis thereof and that is rotationally displaced about the pivot axis from the first lever arm.

The bell cranks are mounted to a power cylinder with the second lever arms thereof extending radially inward toward the piston rod of the power cylinder; and each of the second lever arms include a spherically shaped portion that is proximal to the piston rod.

A dog retainer is fixedly attached to the piston rod and includes a pair of cylindrically shaped openings that are disposed orthogonal to the piston rod, and that receive the spherically shaped portions of the second levers.

Thus, reciprocating movement of the piston rod and the dog retainer results in arcuate movement of the spherically shaped portions, arcuate movement of the second lever arms, and arcuate movement of the first lever arms.

One of the advantages of this prior art design is simplicity in economy of manufacture; however, it has a disadvantage in that the jaw pad surfaces are parallel at only one position of the piston rod of the power cylinder.

In another embodiment of the aforesaid patent application, parallel movement of the jaw pad surfaces is achieved by a slide mechanism; and actuation of the jaw pads is achieved by a cam mechanism.

While this construction achieves the advantage of parallel movement of the jaw pad surfaces, its disadvantages include relatively high manufacturing costs, because of the requirements of ground flat surfaces and close manufacturing tolerances.

DISCLOSURE OF INVENTION

In the broader aspects of this invention, a gripping apparatus is provided that includes a supporting body having two spaced apart frame members that are disposed on opposite sides of the piston rod of a power cylinder and that are attached to the cylinder body of the power cylinder. P First and second bell cranks, each having a pivot axis and each having first and second lever arms that extend radially outward from the respective pivot axis, are disposed intermediate of the frame members and are pivotally attached thereto.

The second lever arms of the bell cranks project radially inward toward the piston rod and each include a spherically shaped portion that is distal from the pivot axis thereof. The first lever arms extend longitudinally outward, somewhat parallel to the cylinder body of the power cylinder, and each include a jaw pad that is pivotally attached to a respective one of the first lever arms at ends thereof that are distal from the pivot axis.

A dog retainer is fixedly attached to the piston rod and includes first and second cylindrically shaped openings that are disposed orthogonally to the axis of the piston rod. The spherically shaped portions of the second lever arms are disposed in respective ones of the cylindrically shaped openings in the dog retainer; so that the reciprocating movement of the piston rod results in arcuate movement of the spherically shaped portions, arcuate movement of the second lever arms, and arcuate movement of the first lever arms.

First and second parallel links are pivotally attached to the frame members and are pivotally attached to respective ones of the jaw pads.

The parallel links cooperate with the first lever arms, with the pivotal attachment of both of the first levers and both of the parallel links to the frame members, and with the pivotal attachment of both of the first lever arms and both of parallel links to the jaw pads, to provide substantially parallel movement of both of the jaw pads, even though the first lever arms move arcuately.

DESCRIPTION OF THE DRAWINGS

Referring now to FIGS. 1 and 2, a gripping apparatus 10 includes supporting body 12 that consists of spaced apart frame members 14*a* and 14*b*, a power cylinder 16 having a piston rod 18, bars or bell cranks 20*a* and 20*b*, jaw pads 22*a* and 22*b*, and a dog retainer 24.

Figure 1:
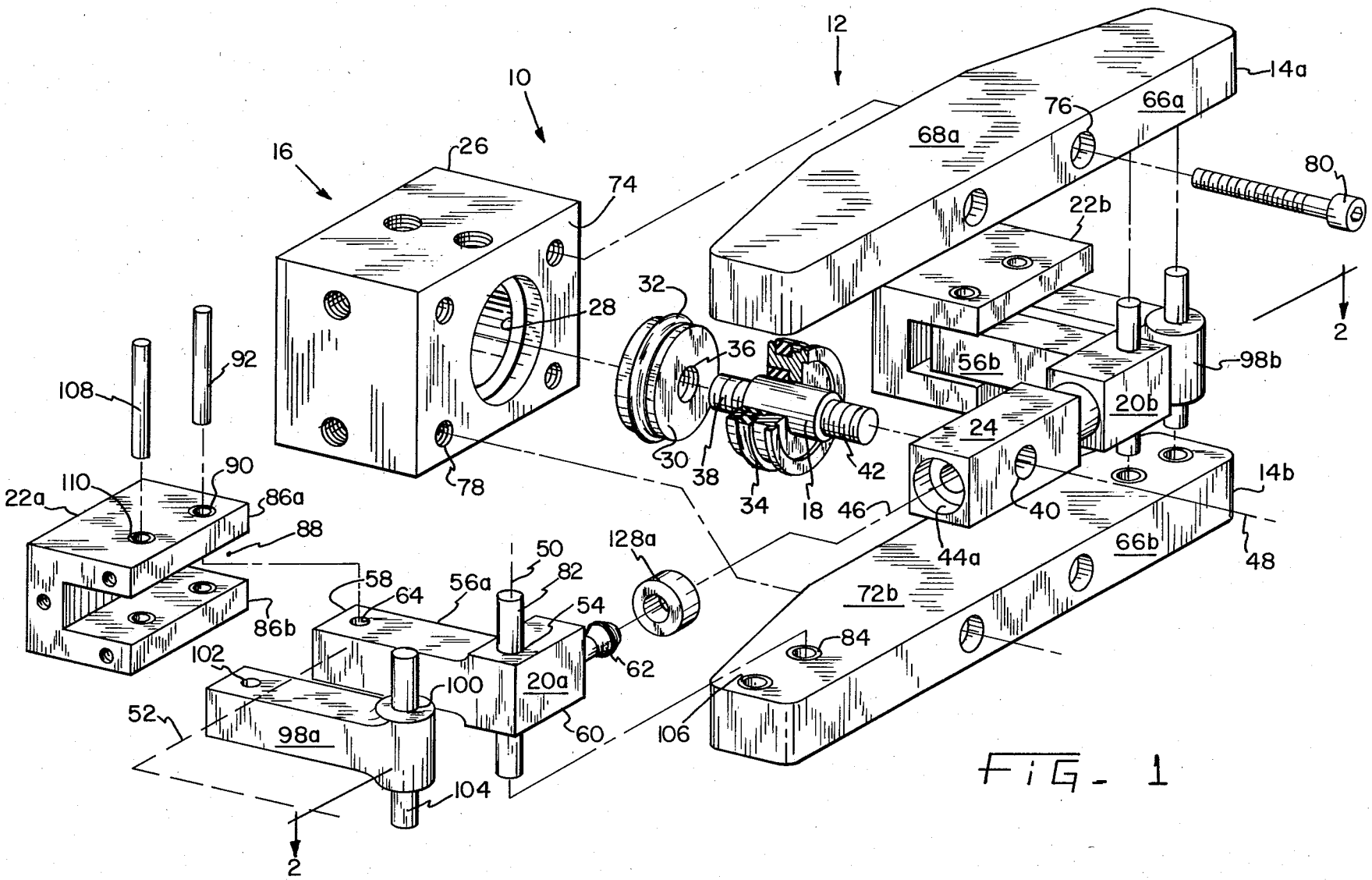
FIG. 1 is an exploded and perspective view of a preferred embodiment of the gripping apparatus.

In addition to the piston rod 18, the power cylinder 16 includes a cylinder body 26 having a cylinder bore 28, a piston 30 that is disposed in the cylinder bore 28 and that includes a piston seal 32, and a cylinder bearing 34 that is disposed in the cylinder bore 28 radially intermediate of the piston rod 18 and the cylinder bore 28.

The piston 30 is attached to the piston rod 18 by means of a threaded opening 36 in the piston 30 and a threaded portion 38 of the piston rod 18.

The dog retainer 24 is attached to the piston rod 18 by means of a threaded opening 40 in the dog retainer 24 and a threaded portion 42 on the piston rod 18.

The dog retainer 24 includes sockets or ball receiving openings 44*a* and 44*b* that are circumferentially disposed around a ball receiving axis 46 that is disposed orthogonally to a longitudinal axis 48 of the power cylinder 16.

The piston rod 18 and the cylinder bearing 34 of the power cylinder 16 cooperate to guide the dog retainer 24 in reciprocating movement along the longitudinal axis 48, and to maintain the ball receiving axis 46 of the sockets 44*a* and 44*b* orthogonal to the longitudinal axis 48.

The bell cranks 20*a* and 20*b* and the additional mechanism which will be described is either identical for left and right side parts, or else the left and right side parts are a mirror image of each other. Therefore, a description for one half of the gripping apparatus will suffice for the complete gripping apparatus.

In like manner, the construction above and below the cross section line 2—2 is identical except for the frame members 14*a* and 14*b*being mirror images of each other. Therefore, a description for one of the frame members, 14*a* and 14*b*, or for similar features of one frame member, 14*a* or 14*b*, will suffice for both.

The bell crank 20*a* includes a pivot axis 50 that is disposed orthogonal to a plane 52, a first pivot hole 54 that is concentric to the pivot axis 50, a first jaw lever or first lever arm 56*a* that includes a remote end 58 that is disposed distal from the pivot axis 50, a second lever arm 60 that includes a spherically shaped portion 62 that is disposed distal from the pivot axis 50, and a second pivot hole 64 in the first lever arm 56*a* that is disposed proximal to the remote end 58 thereof.

The frame member 14*a* includes a first edge surface 66*a*, a second edge surface (not shown), an outer surface 68*a*, and an inner surface (not shown). The frame member 14*b* includes a first edge surface 66*b*, a second edge surface 70*b*, an inner surface 72*b*, and an outer surface (not shown).

The frame members 14*a* and 14*b* are disposed with the inner surfaces, 72*b* (not shown), in parallel and spaced apart relationship to each other, and are mounted to a face 74 of the cylinder body 26 by bolt holes 76 in the frame members 14*a* and 14*b*, threaded holes 78 in the cylinder body 26, and bolts 80.

The bell crank 20*a* is pivotally mounted to the frame members 14*a* and 14*b* by a pivot pin 82 that is disposed in the pivot hole 54 of the bell crank 20*a* and that extends into a first mounting hole 84 in the inner surface 72*b* of the frame member 14*b*; and the spherically shaped portion 62 of the bell crank 20*a* is disposed inside the ball receiving opening 44*a* of the dog retainer 24.

The jaw pad 22*a* includes flanges 86*a* and 86*b* that are disposed on opposite sides of a slot 88. A first attaching hole 90 extends orthogonally through both of the flanges, 86*a* and 86*b*.

The jaw pad 22*a* is pivotally attached to the first lever arm 56*a* of the bell crank 20*a* by a second pivot pin 92 that extends through the second pivot hole 64 of the bell crank 20*a* and into the first attaching hole 90 in both of the flanges, 86*a* and 86*b*.

As described thus far, reciprocating movement of the piston rod 18 of the power cylinder 16 provides reciprocating movement of the retainer 24. This reciprocating movement of the retainer 24 results in arcuate movement of the spherically shaped portion 62 of the bell crank 20*a*, and arcuate movement of the first and second lever arms, 56*a* and 60, about the pivot axis 50.

If the jaw pad 22*a* were fixedly attached to the first lever arm 56*a* of the bell crank 20*a*, instead of being pivotally attached thereto, then a point 94*a* of a pad surface 96*a* of the jaw pad 22*a* would move in an arcuate path as the power cylinder 16 actuates the retainer 24, and the pad surface 96*a* would pivot about the pivot axis 50.

However, a mechanism is provided to maintain the pad surface 96*a* in a constant plane as the first lever arm 56*a* of the bell crank 20*a* is moved accurately.

In addition to the aforementioned parts, the gripping apparatus 10 includes parallel bars or links 98*a* and 98*b*. The parallel link 98*a* includes a first link hole 100 that is disposed orthogonal to the plane 52, and a second link hole 102 that is spaced apart from the first link hole 100 and that is orthogonal to the plane 52.

The parallel link 98*a* is pivotally attached to the frame members 14*a* and 14*b* by a first link pin 104 that extends through the link hole 100 and into a second mounting hole 106 that extends into the frame member 14*b* from the inner surface 72*b* thereof.

The parallel link 98*a* is pivotally attached to the jaw pad 22*a* by a second link pin 108 that extends through the second link hole 102 of the link 98*a* and into attaching holes 110 in both of the flanges, 86*a* and 86*b* of the jaw pad 22*a*.

The distance between the link holes 100 and 102 of the parallel link 98*a* is equal to the distance between the pivot holes 54 and 64 of the bell crank 20*a*. In like manner, the distance between the holes 84 and 106 in the frame member 14*b* is equal to the distance between the holes 90 and 110 in the jaw pad 22*a*.

Therefore, the first lever arm 56*a* of the bell crank 20*a*, and the parallel link 98*a*, with their respective pivotal attachments to the frame members, 14*a* and 14*b*, and to the jaw pad 22*a*, form a parallel linkage.

The result is that the pad surface 96*a* of the jaw pad 22*a* remains in a plane that is parallel to a plane 112 as the first lever arm 56*a* is moved arcuately; and also, the pad surface 96*a* of the jaw pad 22*a* remains in a plane that is parallel to a plane 114 of the jaw pad 22*b*.

Figure 2:
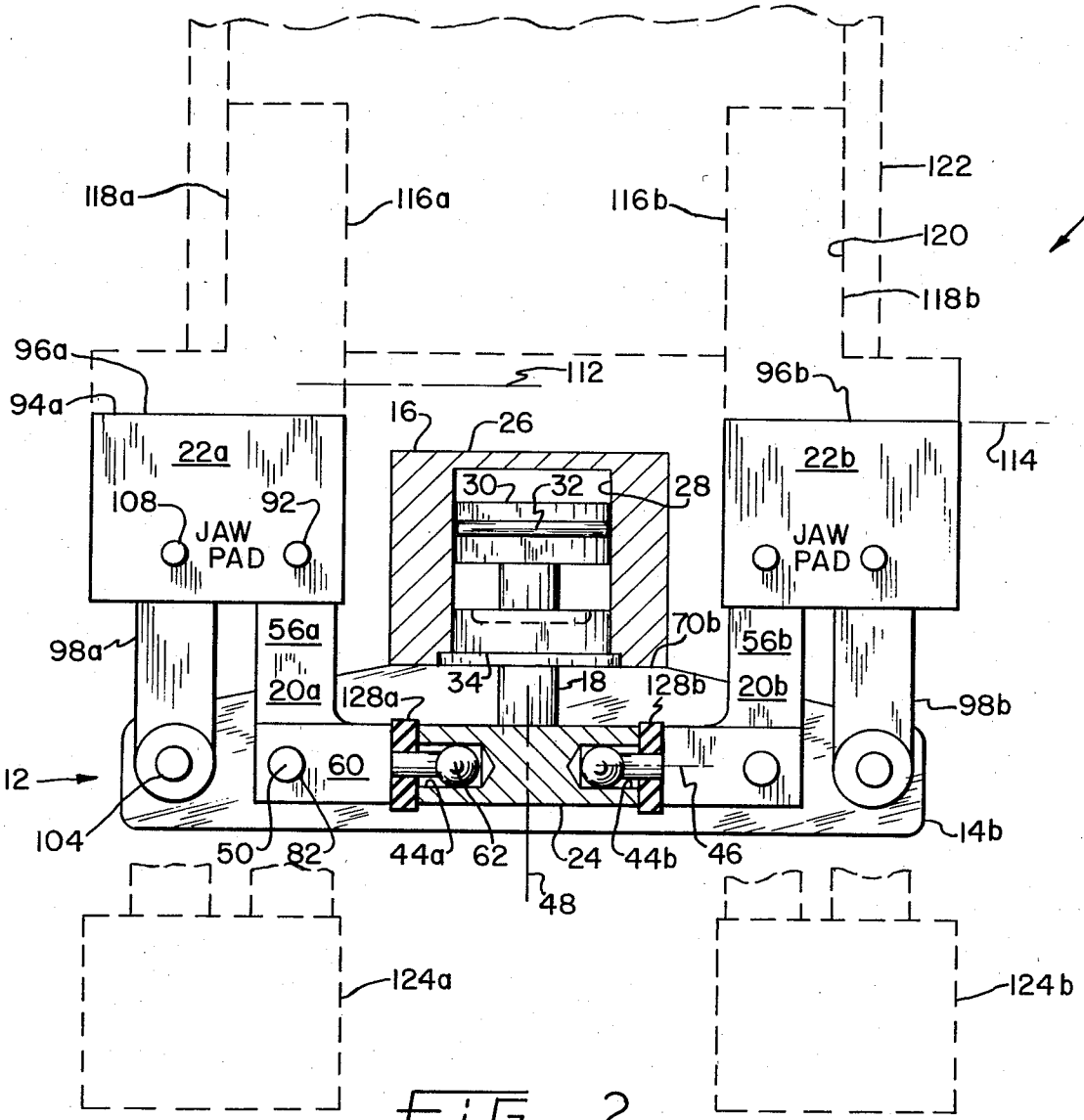
FIG. 2 is a cross sectional view of the embodiment of FIG. 1 taken substantially as shown by section line 2—2 of FIG. 1, and showing, by phantom lines, a modification of the embodiment of FIG. 1 in which the jaw pads are assembled on the opposite side of the frame members.

Referring now to FIG. 2, as shown by phantom lines, a jaw 116*a* may be fitted to the surface 96*a* of the jaw pad 22*a* and attached to the jaw pad 22*a* (by means not shown, not a part of the invention); and a jaw 116*b* may be fitted to the surface 96*b* and may be attached to the jaw pad 22*a* (by means not shown).

The jaws 116*a* and 116*b* include elongated gripping surfaces 118*a* and 118*b*, respectively, which are shaped for gripping the inside surface 120 of a tube 122.

If the jaw pads 22*a* and 22*b* were fixedly attached to the first lever arms 56*a* and 56*b* of the bell cranks 20*a* and 20*b*, then the gripping surfaces 118*a* and 118*b* of the jaws 116*a* and 116*b* would not remain parallel as the jaws 116*a* and 116*b* move radially inward and outward; and the entire longitudinal length of elongated gripping surfaces 118*a* and 118*b* would not make contact with the inside surface 120 of the tube 122 except for a single diametral size of the tube 122.

However, with the inclusion of the parallel links 98*a* and 98*b*, and the resulting parallel linkages, the pad surfaces 96*a* and 96*b* of the jaw pads 22*a* and 22*b* remain parallel to the plane 112 and to each other at all times; and the gripping surfaces 118*a* and 118*b* remain parallel to each other at all times.

Therefore, without regard to changes in the inside diameter of the tube 122, the gripping surfaces 118*a* and 118*b* engage the inside surface 120 of the tube 122 for their entire longitudinal length.

Referring now to FIG. 2, in an alternate assembly of the same parts, as shown by phantom lines 124*a* and 124*b*, the gripping apparatus 10 may be assembled with the first lever arms 56*a* and 56*b* of the bell cranks 20*a* and 20*b* extending longitudinally outward from the first edge surfaces 66*a* and 66*b* of the frame members 14*a* and 14*b*, rather than extending longitudinally outward from the second, 70*b* (not shown), edge surfaces.

Figure 3:
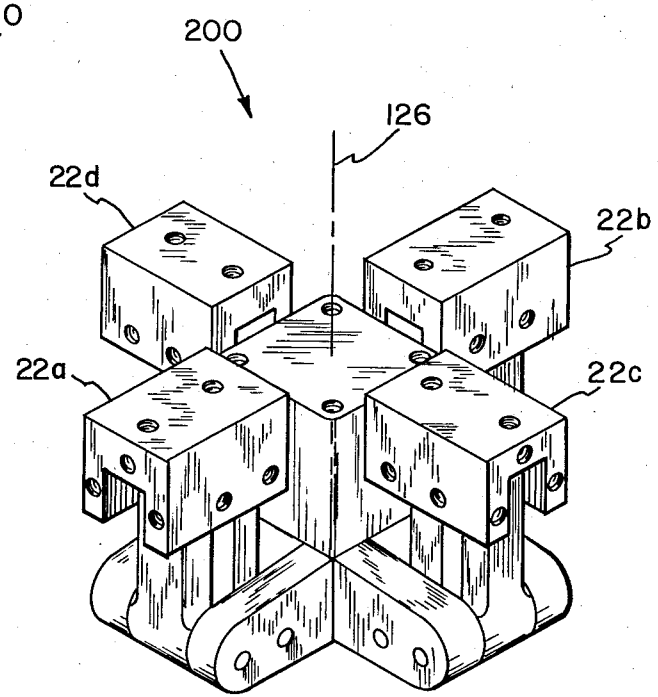
FIG. 3 is a perspective view of an embodiment of the present invention in which four jaw pads are provided.

Referring now to FIG. 3, a gripping apparatus 200 is similar to the gripping apparatus 10 of FIGS. 1 and 2; except that, the gripping apparatus 200 includes four jaw pads 22*a*, 22*b*, 22*c*, and 22*d*, four bell cranks and four parallel links, all similar in construction, all displaced radially around a longitudinal axis 126, all assembled similarly, and all similar in function to the gripping apparatus 10.

In addition to the advantage provided by parallel action of the jaw surfaces 118*a* and 118*b*, as provided by parallel links 98*a* and 98*b*, the gripping apparatus 10 provides advantages in manufacturing cost, reduction of lost motion in the mechanism, and an increase in service life and reliability.

Figure 4:
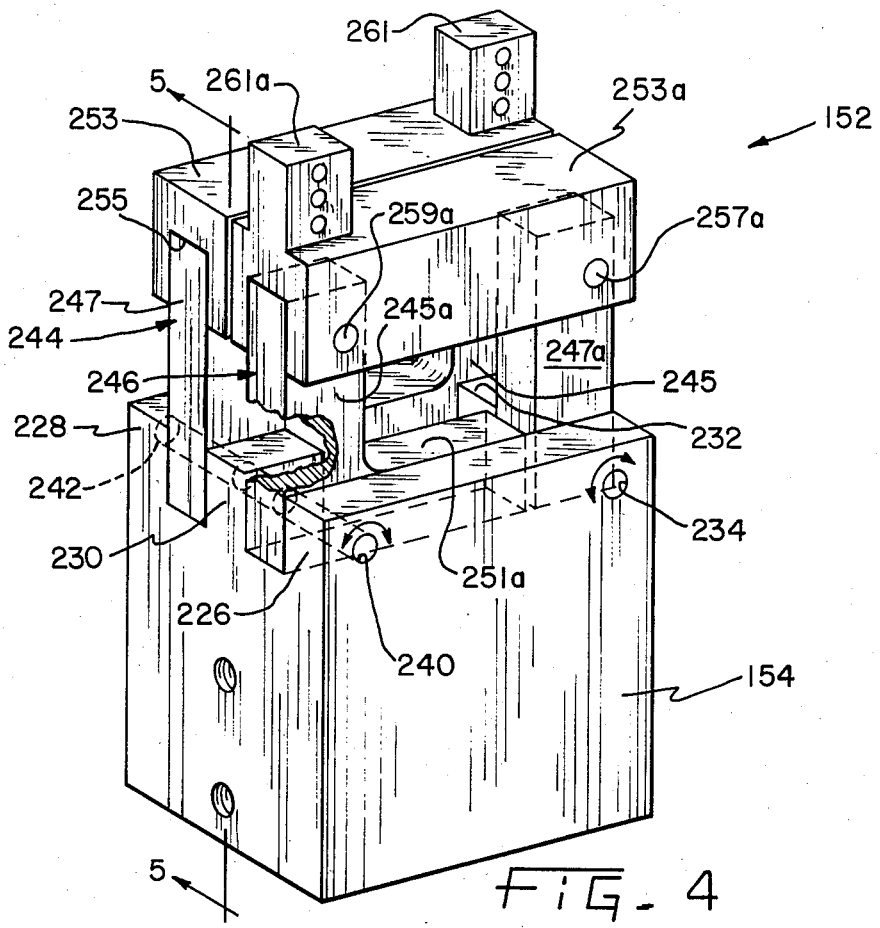
FIG. 4 is a perspective view of another embodiment of this invention.
Figure 5:
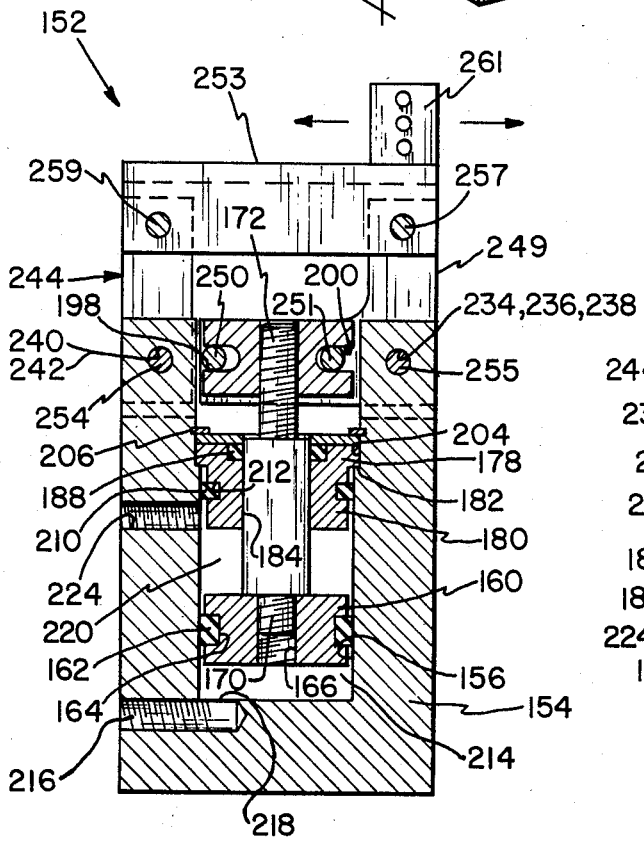
FIG. 5 is a longitudinal section taken substantially along section line 5—5 of FIG. 4.
Figure 6:
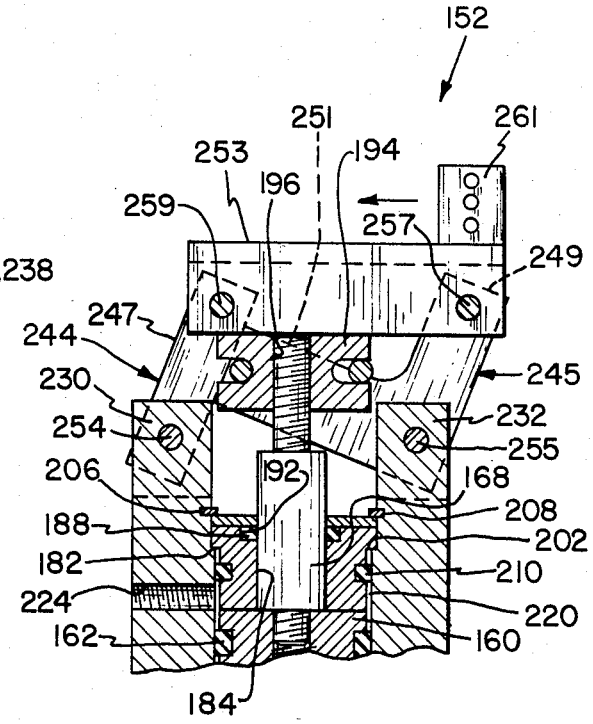
FIG. 6 is a partial sectional view like FIG. 4 showing actuation of the mechanism to one extreme position.

Referring now to FIGS. 4, 5, and 6, another embodiment of the present invention is illustrated in the form of gripping apparatus 152, which is generally of a smaller scale than the gripping apparatuses previously disclosed. Gripping apparatus 152 is similar to the preceding apparatus in that it has a body 154 with a bore 156 for reciprocably receiving piston assembly 158. Piston assembly 158 comprises piston 160 having a piston seal 162 received in companion groove 164 and a threaded bore 166 axially disposed therein. Piston rod 168 has threaded end 170 secured within threaded bore 166, and set screw 172 disposed on its end opposite from threaded end 170. Piston rod 168 may be secured to piston 160 other than by threaded engagement, and set screw 172 may be integral to piston rod 168. Set screw 172 has a hex opening extending axially in the distal threaded end portion.

Piston assembly 158 comprises bushing 178 having a narrow bushing neck 180 forming bushing shoulder 182 and slidably receives piston rod 168 in opening 184 axially disposed therein. Seal 188 is received in companion groove 192 in bushing 178 and seals piston rod 168 in opening 184. Pin retainer 194 having threaded hole 196 is threadedly engaged with threaded end portion 172 as shown, and has oppositely disposed slots 198, 200, the axes of these slots being parallel and generally perpendicular to the axis of the threaded hole 196.

With piston 160 and bushing 178 received in bore 156, bushing shoulder 182 engages shoulder 202 formed by counter bore 204. Bushing 178 is secured within bore 156 by snap-ring 206 snap-fitted in circular groove 208 in bore 156, and is sealed against bore 156 by O-ring 210 in groove 212. Piston 160 and bushing 178 define in bore 156 fluid chamber 214 communicating with port 216 through opening 218 and annular fluid chamber 220 communicating with port 224. Chambers 214 and 220 are variable volume chambers into which a pressure fluid is selectively introduced alternately through ports 216, 224, respectively, to reciprocate piston 160 in bore 156.

Body 154 has two parallel spaced apart wall-like projections 226, 228 extending axially of and on diametrically opposite sides of bore 156, and two lugs 230, 232 disposed between such projections 226, 228 on diametrically opposite sides of bore 158. Disposed in projection 226, lug 232, and projection 228 are holes 234, 236, 238, respectively, in axial alignment with each other, and disposed within projection 226, lug 230 and projection 228 are holes 240 and 242 in axial alignment with each other. The apparatus 152 is provided with two jaw assemblies generally indicated by the numerals 244 and 246, respectively, pivotally connected between projections 226, 228 and lugs 230, 232. For example, jaw assembly 244 is pivotally mounted between projection 228 and the two lugs 230 and 232, respectively. Jaw assembly 246 is pivotally connected between projection 226 and the same two lugs 230, 232. A description of one jaw assembly will suffice for both, since they are identically constructed but are positioned in reverse on the supporting body 154.

Referring to the jaw assembly 244, which is shown in detail in FIGS. 5 and 6, it comprises two spaced parallel bars 245 and 247 pivotally connected to the body 154 by means of two pins 254 and 255 which fit the previously described pivot openings 234, 236, 238, 240 and 242, respectively. The bar 245, sometimes referred to as a jaw lever, is L-shaped and as such has two arms 249 and 251. The bar 247, sometimes referred to as a link or parallel link, is merely a straight flat piece of essentially the same length as arm 249 of the L-shaped bar 245. An elongated jaw member, sometimes referred to as a jaw pad 253, has an elongated groove 255 which fits over the upper ends of the bars 245 and 247 as shown and receive therethrough two pivot pins 257 and 259 as shown. The horizontal distance between the two pivot pins 257 and 259 is equal to the spacing between the two pins 254 and 255, and further, an imaginary line drawn between the centers of the two pivot pins 257 and 259 is arranged to be parallel to an imaginary line drawn through the centers of the two pivot pins 254 and 255. Therefore, upon swinging movement of either of the two bars 245 and 247, the same swinging movement will be imparted by means of the jaw member 253 to the other bar whereby the two bars and the bar member move as an assembly with the two previously mentioned lines always remaining parallel. FIG. 5 shows the two bars 245 and 247 being extended straight from the body 154 so as to symmetrically straddle and parallel the thrust line or axis of the piston 178. In FIG. 6, the bars are shown swung to the extreme position in one direction. The bars can be swung in the opposite direction by an equal amount depending upon the position of the piston 178 in the bore 156.

Upstanding from the jaw member 253 is an attachment post 261 by means of which a suitable jaw part, not shown, may be attached. The pin retainer 194 is sized to fit between the two lugs 230 and 232 and also the two jaw assemblies 244 and 246 with enough clearance being provided so that the pin retainer 194 can move vertically without obstruction. The left-hand end of the arm 251 of the jaw bar 245 has a laterally extending pin 250 which fits into the notch 198 as shown. Thus, as the piston 160 moves upwardly to the position shown in FIG. 6, the pin retainer 194 will be moved upwardly to the position shown thereby swinging the L-shaped bar 245 clockwise carrying with it the parallel bar 247. Conversely, by moving the piston 160 downwardly to the extreme bottom of its stroke as shown in FIG. 5, the pin retainer 194 will be moved downwardly a corresponding distance thereby swinging the bar assembly 245 toward the left a corresponding distance.

The bar assembly 246 is made identically to that just described for bar assembly 244 with the same reference numerals having the suffix "a" identifying identical parts. As is clearly shown in FIG. 4, the two jaw members 253 and 253*a* are essentially elongated, rectangular members with the flat, parallel and juxtaposed sides either being slidably engageable or separated by a small clearance. The arm 251*a* has a pin 251 (FIG. 5) which fits the slot 200 of the pin retainer 194 thereby completing the hook up of the jaw assemblies to the piston 160. Upon reciprocation of the piston 160, the pin retainer 194 will be correspondingly reciprocated thereby causing the pin assemblies 244 and 246 (FIG. 4) to swing oppositely, at all times keeping the jaw members 253 and 253*a* essentially parallel. With these jaw members 253, 253*a* being congruent with the upper surfaces as shown in FIG. 5 flat and horizontal, regardless of the position of the piston 160 within its bore, these same surfaces will be maintained parallel. By the same token, the upstanding posts 261, 261*a* will also remain parallel.

In operation, pressure fluid and exhaust pressure may be connected to the two parts 216 and 224 for causing reciprocation of the piston 160. By disposing the pivots for the jaw assemblies on opposite sides, respectively, of the piston 160 and its bore and more particularly equidistant from and symmetrical with respect to the axis of the piston and its thrust line, the gripping apparatus may be kept to a minimum in size and compactness.

Reduction in manufacturing cost is achieved by elimination of the grinding operations which are required to provide accurate surfaces for mechanisms that utilize slide mechanisms, such as the one which was disclosed in the aforementioned copending patent application.

Reduction in manufacturing cost is achieved by the use of machining operations, such as hole reaming and pin grinding, that are more economical than grinding of flat surfaces.

Reduction in manufacturing cost is achieved by elimination of close fitted parts, such as are required to eliminate lost motion of a slide type mechanism.

Reduction in manufacturing costs is achieved by the use of materials that are more easily machined than those of the aforementioned slide mechanism. Rather than hardened steel, it is possible to use aluminum, plastic or composition materials.

Reduction in lost motion is achieved by elimination of the close tolerances that are required to guide the jaw pads in a slide type mechanism.

Reduction in lost motion is achieved by elimination of the cam mechanism that is required for a slide type mechanism.

Improved service life is achieved by elimination of the exposed sliding surfaces, of a slide type mechanism, which are subject to contamination and accelerated wear.

Reduced sensitivity to contamination, improved reliability, and extended service life are all provided by inclusion of a rubber washer 128*a* that is interposed intermediate of the second lever arm 60 of the bell crank 20*a* and the dog retainer 24, and a similar rubber washer 128*b* that is similarly placed.

Improved reliability and extended service life are provided by the rubber washer 128*a* which seals the ball receiving opening 44*a*, and which provides a sealed cavity for sealably enclosing a lubricating grease for both the ball receiving opening 44*a* and the spherically shaped portion 62.

While the present invention has been described in particular embodiments, it will be understood that it is capable of further modifications. This application is therefore intended to cover any variations, uses, adaptations of the invention following the general principles thereof, and including such departures from the present disclosure as come within known or customary practice in the art to which this invention pertains and which fall within the limits of the appended claims.

INDUSTRIAL APPLICABILITY

The present invention provides pneumatically or hydraulically operated gripping apparatus in which parallel movement of the gripping jaws is achieved by use of a parallel link mechanism.

By achieving parallel movement of the gripping jaws, the present invention is adaptable for use in gripping operations where non-parallel movement of the gripping jaws would not grip work pieces securely, or where different sizes of work pieces could not be gripped securely without changing the gripping jaws for different size pieces.

The present invention is useful in a variety of automated manufacturing and processing application in general, and in robotic machines in particular.

While there have been described above the principles of this invention in connection with specific apparatus, it is to be clearly understood that this description is made only by way of example and not as a limitation to the scope of the invention.

What is claimed is:

1. A gripping apparatus which comprises:

a supporting body;

a first jaw lever pivotally attached to said supporting body and having a remote end that is distal from said pivotal attachment thereof;

means carried by said supporting body for actuating said remote end of said jaw lever arcuately about said pivotal attachment thereof said actuating means including an actuator movable in a straight line;

jaw pad means attached to said supporting body for performing a gripping operation as said remote end of said jaw lever is moved arcuately by said actuating means, said first jaw pad being pivotally attached to the remote end of said jaw lever; and parallel link means, comprising a link that is parallel to said first jaw lever and pivotally attached to said first jaw pad distal from said pivotal attachment of said jaw lever thereto, and that is pivotally attached to said supporting body distal from said pivotal attachment of said jaw lever thereto, for arcuately positioning said first jaw pad around said pivotal attachment of said jaw lever with said supporting body, and for achieving parallel movement of said first jaw pad as said jaw lever is moved arcuately.

2. A gripping apparatus as claimed in claim 1 in which said jaw pad means is disposed radially outward from said straight line;

said arcuate movement of said remote end of said jaw lever comprises movement of said remote end substantially toward and away from said straight line; and said jaw pad means comprises a second jaw pad that is disposed diametrically opposite to said first jaw pad.

3. A gripping apparatus as claimed in claim 1 in which said jaw pad means is disposed radially outward from said straight line;

said jaw pad means comprises a second jaw pad that is disposed diametrically opposite said first jaw pad, and a third jaw pad that is disposed circumferentially between said first and second jaw pads.

4. A gripping apparatus which comprises:

a supporting body;

a first jaw lever pivotally attached to said supporting body and having a remote end that is distal from said pivotal attachment thereof;

means carried by said supporting body for actuating said remote end of said jaw lever arcuately about said pivotal attachment thereof said actuating means including an actuator movable in a straight line;

jaw pad means attached to said supporting body for performing a gripping operation as said remote end of said jaw lever is moved arcuately by said actuating means, said first jaw pad being pivotally attached to the remote end of said jaw lever;

parallel link means, comprising a link that is parallel to said first jaw lever and pivotally attached to said first jaw pad distal from said pivotal attachment of said jaw lever thereto, and that is pivotally attached to said supporting body distal from said pivotal attachment of said jaw lever thereto, for arcuately positioning said first jaw pad around said pivotal attachment of said jaw lever with said supporting body, and for achieving parallel movement of said first jaw pad as said jaw lever is moved arcuately;

said jaw pad means being disposed radially outward from said straight line;

said arcuate movement of said remote end of said first jaw lever comprises movement of said remote end substantially toward and away from said straight line;

said jaw pad means comprises a second jaw pad disposed opposite to said first jaw pad;

said attachment of said jaw pad means to said supporting body comprises a second jaw lever having a second remote end, pivotal attachment of said second jaw pad to said second jaw lever poximal to said second remote end thereof, and pivotal attachment of said second jaw lever to said supporting body distal from said attachment of said first jaw lever to said supporting body;

said actuating means being connected to said second jaw lever for moving said second remote end arcuately; and second parallel link means, comprising a second link that is pivotally attached to said second jaw pad distal from said pivotal attachment of said second jaw lever thereo, and that is pivotally attached to said supporting body distal from said pivotal attachment of said second jaw lever thereto, for arcuately positioning said second jaw pad around said pivotal attachment of said second jaw lever with said supporting body, and for achieving parallel movement of said second jaw pad as said second jaw arm is moved arcuately.

5. A gripping apparatus as claimed in claim 4 in which said first jaw lever comprises a bell crank having a crank axis, having a first lever arm that extends radially outward from said crank axis, and having a second lever arm that extends radially outward from said first lever arm and that is angularly disposed around said crank axis from said first lever arm;

said pivotal attachment of said first jaw lever to said supporting body comprises pivotal attachment of said bell crank to said supporting body at said crank axis.

6. A gripping apparatus as claimed in claim 5 in which said second lever arm of said bell crank includes a ball shaped portion that is disposed distal from said pivot axis;

a dog retainer provided with a cylindrical socket circumferentially disposed around a ball receiving axis, said ball receiving axis extending transversely to said straight line;

said ball shaped portion being disposed within said socket and said actuating means including said dog retainer for moving the latter along said straight line.

7. A gripping apparatus as claimed in claim 6 in which said actuating means comprises a power cylinder having a cylinder body which is included within said supporting body, a cylinder bore in said cylinder body having a longitudinal axis concident with said straight line, a piston disposed in said bore, a piston rod that is attached to said piston that extends outward from said cylinder bore concentric with said longitudinal axis, and cylinder bearing means disposed radially intermediate of said piston rod and said cylinder bore for guiding said piston rod along said longitudinal axis;

said means for guiding said dog retainer along said straight line comprises said piston rod and said cylinder bearing means.

8. A gripping apparatus as claimed in claim 7 in which said supporting body comprises first and second frame members each having inner surfaces, outer surfaces, first edge surfaces, and second edge surfaces, and being disposed with said inner surfaces parallel and spaced apart;

said pivotal attachment of said bell crank and said parallel link to said supporting body comprises a first pivot hole in said bell crank that is concentric with said pivot axis, a first link hole in said parallel link, first and second mounting holes in both of said frame members that extend orthogonally outward from said inner surface, a first pivot pin that extends through said first pivot hole in said bell crank and into one of said mounting holes in both of said frame members, and a second pivot pin that extends through said first link hole and into the other of said mounting holes in both of said frame members; and said attachment of said power cylinder to said supporting body comprises bolting said frame members to said power cylinder on opposite sides of said piston rod with one of said edge surfaces of said frame members operatively engaging said power cylinder.

9. A gripping apparatus as claimed in claim 8 in which said first lever arm of said bell crank extends outward from said first edge surfaces of said frame members.

10. A gripping apparatus as claimed in claim 8 in which said first lever arm of said bell crank extends outward from said second edge surfaces of said frame members.

11. A gripping apparatus comprising a supporting body, a first pair of spaced parallel bars pivotally connected at first ends thereof to said supporting body at spaced first locations thereon, a first jaw member pivotally connected at spaced points thereon to the second ends of said bars, the four pivotal connections being at the corners of an imaginary parallelogram whereby a line drawn through the pivotal connections on said body remains parallel to a line drawn through the pivotal connections on said jaw member during pivotal movement of said parallel bars;

a second pair of spaced parallel bars pivotally connected at first ends thereof to said supporting body at spaced second locations thereon, a second jaw member pivotally connected at spaced points thereon to the second ends of said second bars, the axes of the pivotal connections to said first and second parallel bars being parallel, the four pivotal connections on said second bars also being at the corners of an imaginary parallelogram whereby lines drawn through the pivotal connections on said body and on said second jaw member, respectively, remain parallel during pivotal movement of said second bar; the first and second mentioned two lines, respectively, defining spaced parallel planes, an actuating member reciprocably mounted in said supporting body and operably connected to said bars to pivot said first bars and said second bars in unison and oppositely.

12. The apparatus of claim 11 wherein said actuating member is mounted for movement in a direction parallel to said planes and normal to a plane perpendicular thereto and including one of said imaginary lines drawn between pivotal connections on a jaw member.

13. The apparatus of claim 11 wherein said aforesaid parallelograms are congruent, and the axes of the pivotal connections of the first and second spaced locations are coincident.

14. The apparatus of claim 13 wherein said supporting body has two parallel and oppositely disposed wall projections outwardly extending therefrom and two lug members outwardly extending therefrom between and spaced from respective ends of said wall projections, one each of said first and second bars being pivotally supported between one of said lug members and the two wall projections, respectively, by means of a wrist pin received therethrough which constitutes one of said pivotal connections, the other of said first and second bars being pivotally supported between the other of said wall projections and the other lug member by means of a wrist pin received therethrough which constitutes another of said pivotal connections.

15. The apparatus of claim 14 wherein one each of said first and second bars have arms which extend from respective pins toward the other wrist pins and on opposite sides of said actuating member, respectively, said arms being laterally juxtaposed, the remote end of each opposite side of said actuating member from its respective wrist pin and having a pin member extending outwardly therefrom parallel to the axes of said wrist pins, said actuating member having a pair of slots oppositely disposed therein for receiving respective pin members.

16. The apparatus of claim 15 including reciprocating means in the form of a piston-cylinder assembly in said supporting body and includes a piston rod disposed between said piston and said actuating member, said arms on said bars extending in opposite directions from the axis of said piston rod, said piston rod being rigidly secured to said piston and threadedly engaged with said actuating member, the stroke of said piston in said cylinder being axially adjustable by threadedly adjusting said piston rod relative to said actuating member, thereby angularly adjusting the pivotal movement of said bars.

* * * * *